United States Patent [19]

Bozek et al.

[11] B 3,982,658

[45] Sept. 28, 1976

[54] EASY OPENING CONTAINER WITH RETAINED CLOSURE

[75] Inventors: John S. Bozek, Chicago; Harry A. Peyser, Olympia Fields, both of Ill.

[73] Assignee: Continental Can Company, Inc., New York, N.Y.

[22] Filed: May 19, 1975

[21] Appl. No.: 578,447

[44] Published under the second Trial Voluntary Protest Program on January 20, 1976 as document No. B 578,447.

Related U.S. Application Data

[63] Continuation of Ser. No. 513,433, Oct. 9, 1974, abandoned, which is a continuation of Ser. No. 365,003, May 29, 1973, abandoned.

[52] U.S. Cl. ..... 220/337; 220/268; 220/339; 220/359

[51] Int. Cl.[2] ..... B65D 43/14; B65D 51/04

[58] Field of Search ..... 220/260, 265, 268, 337, 220/339, 359; 229/7 R

[56] References Cited

UNITED STATES PATENTS

| | | | |
|---|---|---|---|
| 3,731,835 | 5/1973 | Hawkins et al. | 220/359 X |
| 3,871,550 | 3/1975 | Chiappe | 220/339 |
| 3,889,842 | 6/1975 | Bennett | 220/268 |

*Primary Examiner*—George T. Hall

*Attorney, Agent, or Firm*—John J. Kowalik; Joseph E. Kerwin; William A. Dittmann

[57] ABSTRACT

An easy opening end closure for a container in which the end closure includes a panel having a pre-cut pour opening. The pour opening is sealed by a plastic closure having a portion permanently bonded to the underside of the end. A remaining portion is releasably adhered to the underside so that upon downward pressure on the closure, it is released and hinges about the permanently bonded portion. A tongue integral with the panel projects into the opening along the edge along which the flap hinges and is permanently bonded thereto.

11 Claims, 4 Drawing Figures

FIG. 1
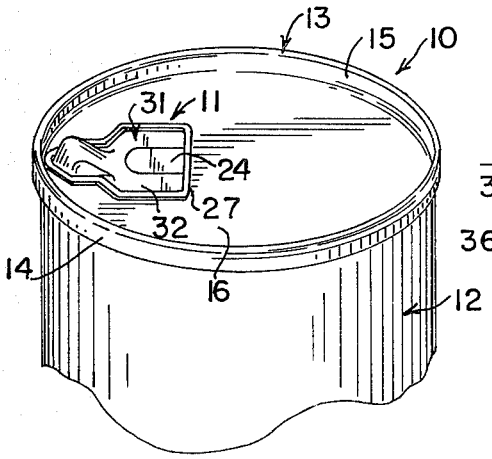
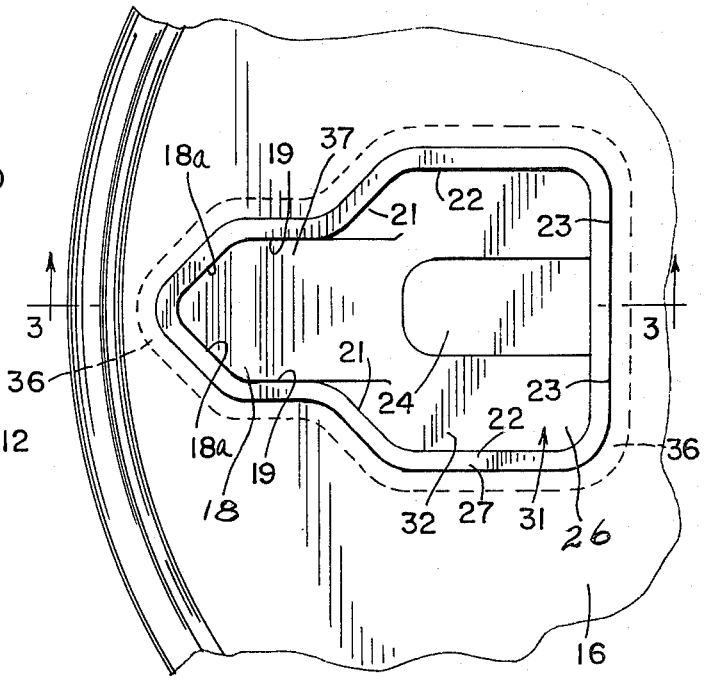
FIG. 2
FIG. 3
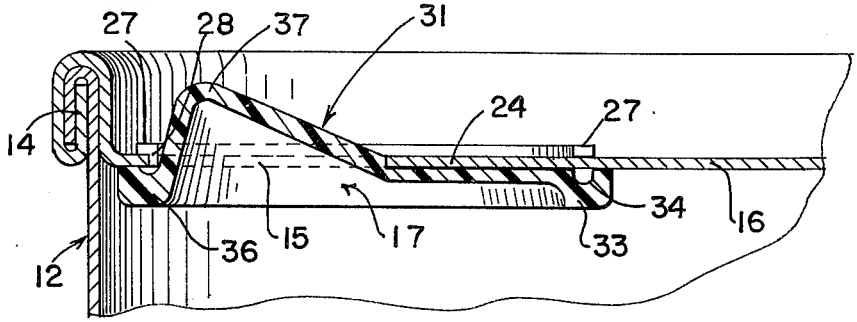
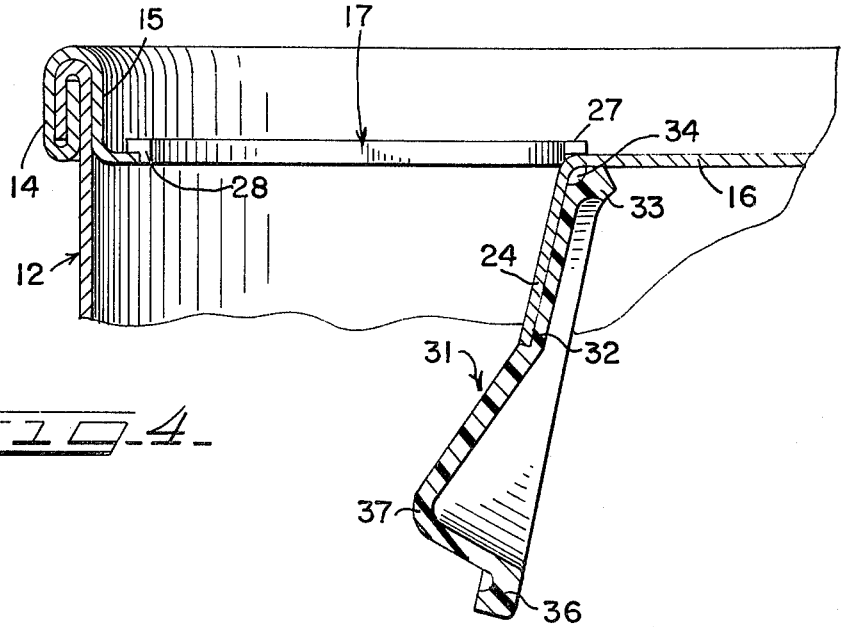
FIG. 4

EASY OPENING CONTAINER WITH RETAINED CLOSURE

This application is a continuation of our application Ser. No. 513,433, filed Oct. 9, 1974 now abandoned, which is a continuation of U.S. Ser. No. 365,003, filed May 29, 1973 now abandoned.

BACKGROUND AND SUMMARY OF THE INVENTION

The present invention relates to easy opening containers and more particularly to an improved easy opening structure having a closure which is opened by the application of inward pressure to depress the closure into the container.

Push-in closures are well known as exemplified by U.S. Pat. Nos. 3,246,791, 334,775 and 3,236,409. The structure disclosed in these patents includes a closure member which is formed from a separate piece of material or from the metal end closure itself. These structures also each have a raw cut edge exposed to the product prior to opening or a cut edge exposed after opening.

The raw exposed edge prior to opening should be covered to prevent exposure and reaction with the product. The cut exposed edge after opening is undesirable because it may cause injury to the user of the container, particularly, if the container contents are of the type which may be consumed directly through the opening.

One form of an easy opening structure for overcoming these difficulties is disclosed in U.S. patent application Ser. No. 365,004 filed concurrently with the parent application and assigned to the assignee of the present invention. This is an end closure having a precut pour opening. A plastic collar having a depending flange is seated in the opening and bonded to the end closure. The depending flange is in overlying relationship to the cut edge to prevent exposure thereof. A plastic closure member including an attachment ledge and a flap hingedly fastened thereto is bonded to the underside of the end closure to seal the opening. The flap is releasably bonded to the end closure so as to releasable and hingedly pivoted about the attachment ledge upon application of inward pressure thereon. The present invention is an improvement to the structure shown in the above mentioned application and includes a tongue which is integral with the panel and projects into the opening along the edge about which the flap hinges. The flap is permanently secured to the flap so that the reclosure of the opening after the marginal portions are released is resisted.

BRIEF DESCRIPTION OF THE DRAWINGS

FIG. 1 is a fragmentary perspective view of one end of a container embodying the easy opening structure of the present invention.

FIG. 2 is an enlarged fragmentary top plan view of the easy opening structure.

FIG. 3 is a cross-sectional view taken generally along the lines 3—3 of FIG. 2.

FIG. 4 is a cross-sectional view similar to FIG. 3 but showing the closure in an open position.

DESCRIPTION OF THE PREFERRED EMBODIMENTS

Referring now to the drawings in particular FIGS. 1–4, there is shown a can 10 embodying the easy opening structure 11 of the present invention. The can 10 includes a body 12 having a metal end closure 13 attached to one end thereof by means of a double seam 14. The end closure 13 includes an upstanding chuck wall 15 and a panel 16.

A pre-cut opening 17 is provided in the panel 16. The opening 17 is formed with a relatively narrow end portion 18 including two inclined merging sides **18*a*—18*a*. The inclined sides 18*a*—18*a* extend from parallel sides 19-19 which are joined to inclined sides 21—21. The inclined sides 21—21 extend from relatively widely spaced parallel sides 22—22 which project at right angles from end edges 23—23. Extending inwardly from the end edges 23—23 is a tongue 24 which projects into the relatively wide rectangular portion 26 of the opening 17.**

The narrow portion 18 is sized so as to prevent the insertion of a finger therein. The tongue 24 tends to inhibit the entry of a finger into the wide rectangular opening portion 26.

Adhered to the upper surface by a suitable bonding means is a plastic collar 27. The collar 27 includes a downwardly depending flange 28 extending about the cut edges defining the opening 17. The flange 28 serves to prevent cutting by the edge and also covers the latter to prevent any reaction of the metal with the contents of the container.

A closure 31 made from plastic such as polythylene or polypropylene contoured similarly but somewhat larger than the opening 17 is bonded to the underside of the panel 16 as shown in FIGS. 3 and 4. The closure 31 includes a flap 32 and an attachment band 33 integrally connected at a reduced section 34 defining a hinge line about which flap 32 is pivoted. The flap 32 and the attachment band 33 extending outwardly of the edges of the opening 17 is formed of somewhat thicker material and includes a marginal edge portion 36 releasably adhered to the underside of the panel to adjacent edges **18*a*—18*a*, 19—19, 21—21 and 22—22. The portion of the flap 32 underlying the tab 24** is permanently bonded thereto.

The flap 32 is provided with a raised button portion 37 which projects about the upper surface of the panel. Upon downward depression on the button portion 37, the marginal portion 37 is released from bonding engagement with the underside of the end. At the same time, the tongue 24 bends downwardly and the flap 32 turns about the hinge 34. Since tongue 24 is permanently bonded to the flap 32 it thereby serves to retain the flap 32 depressed inwardly to provide an unobstructed opening 17.

What is claimed is:

1. An easy opening end closure for a container comprising a metal panel, an opening formed in said panel, a closure made from plastic material underlying said opening and having a closure flap, an attachment band hingedly attached to said flap and permanently bonded to the underside of said panel, marginal edge portions about said flap releasably bonded to the underside of said opening, and a tongue integral with said panel extending into said opening from the edge along which said attachment panel is permanently bonded, said tongue being permanently secured to said flap.

2. The invention as defined in claim 1 wherein said closure flap includes a projection extending above said panel.

3. The invention as defined in claim 2 wherein said opening includes a portion of restricted area lesser than that permitting the insertion of a finger, and said projection extends through said restricted opening.

4. The invention as defined in claim 1 wherein a collar made from a plastic material is bonded about the edge of said opening to cover a cut edge.

5. An easy opening end closure for a container comprising a metal panel having pour aperture means, a closure flap comprising plastic material closing said aperture means, means providing an attachment hinge for the flap permanently connected to the panel, means in the region of said pour aperture means releasably bonding the flap to the panel in closing relation to said pour aperture means, and a tongue bridging from the flap to the panel and permanently associated therewith, said tongue being formed of material which is bendable upon deflection of the flap attendant to opening of said aperture means and retains its shape to hold the flap in a non-obstructing position away from said aperture means to permit drinking directly from the container and not to impede flow of product from the container.

6. The invention according to claim 5 wherein said tongue is formed of metal.

7. The invention according to claim 5 wherein said closure flap is formed partially of polypropylene and partially of metal.

8. The invention according to claim 5 wherein said closure flap comprises a thick perimetric edging and a thin band of material connecting the edging with the flap.

9. The invention according to claim 5 wherein said closure is made of polyethylene.

10. The invention according to claim 5 wherein said closure and said tongue overlie said aperture means and both collectively resist blow-out of said closure means.

11. An easy opening end closure for a container comprising a panel having pour aperture means, a closure flap comprising plastic material closing said aperture means, first attachment means permanently bonding a portion of said flap to the panel, second attachment means in the region of said pour aperture means releasably bonding a second portion of the flap to the panel in closing relation to said pour aperture means, and a flexible member coacting with the flap, said flexible member and said flap being bendable with deflection of the flap during opening of said aperture means, said flexible member being formed of material having characteristics when bent in the course of unclosing said opening to restrain said second portion of said flap in a non-obstructing position away from said aperture means to permit drinking directly from the container and not to impede flow of product from the container.

* * * * *